US009322614B2

(12) United States Patent
Williams et al.

(10) Patent No.: US 9,322,614 B2
(45) Date of Patent: Apr. 26, 2016

(54) FRONT IRON SIGHT FOR A FIREARM PROVIDING A TUBULAR APERTURE THROUGH A HOUSING WITH TOP OPENING FOR LIGHT AND METHODS OF USE

(71) Applicant: The DW Battlesight, LLC, Vidor, TX (US)

(72) Inventors: Dwight P. Williams, Vidor, TX (US); Kenneth W. Lloyd, Vidor, TX (US)

( * ) Notice: Subject to any disclaimer, the term of this patent is extended or adjusted under 35 U.S.C. 154(b) by 40 days.

(21) Appl. No.: 14/249,449

(22) Filed: Apr. 10, 2014

(65) Prior Publication Data

US 2015/0226520 A1 Aug. 13, 2015

Related U.S. Application Data

(60) Provisional application No. 61/853,836, filed on Apr. 12, 2013, provisional application No. 61/854,899, filed on May 3, 2013.

(51) Int. Cl.

| | |
|---|---|
| ***F41G 1/02*** | (2006.01) |
| ***F41G 1/01*** | (2006.01) |
| *F41G 1/08* | (2006.01) |

(52) U.S. Cl.

CPC .. *F41G 1/02* (2013.01); *F41G 1/01* (2013.01); *F41G 1/08* (2013.01)

(58) Field of Classification Search

CPC ..... F41G 1/345; F41G 1/42; F41G 1/04; F41G 1/08; F41G 1/01; F41G 1/02

USPC ..... 42/132, 142, 143, 144, 145, 111, 112, 42/113, 133

See application file for complete search history.

(56) References Cited

U.S. PATENT DOCUMENTS

| | | | | | |
|---|---|---|---|---|---|
| 830,868 | A | * | 9/1906 | Watson | F41G 1/02 42/144 |
| 1,012,427 | A | | 12/1911 | Peddle | |
| 1,653,924 | A | * | 12/1927 | Parker | F41G 1/04 42/130 |
| 2,030,312 | A | | 5/1933 | Mossberg | |
| 2,101,303 | A | | 12/1936 | Loomis | |
| 2,353,133 | A | * | 7/1944 | Gorman | F41G 1/04 42/130 |
| 2,479,277 | A | | 8/1949 | Terhaar | |
| 2,706,335 | A | | 9/1949 | Munsey | |
| 2,825,137 | A | | 3/1956 | Meetin | |

(Continued)

FOREIGN PATENT DOCUMENTS

| | | |
|---|---|---|
| CN | 2449182 Y | 9/2001 |
| DE | 22113592 A1 | 9/1972 |

(Continued)

OTHER PUBLICATIONS

NPL: http://www.1911pro.com/forum/viewtopic.php?f=7&t=1108 Feb. 9, 2012.*

(Continued)

*Primary Examiner* — Samir Abdosh
*Assistant Examiner* — John D Cooper

(57) ABSTRACT

A front iron sight for a firearm including a housing defining an open unobstructed tubular aperture for a sightline therethrough and a partially open top portion, and preferably with a leading end of the front iron sight housing including a straight flat top portion and straight exterior side wall portions.

11 Claims, 7 Drawing Sheets

(56) References Cited

U.S. PATENT DOCUMENTS

| | | | | | |
|---|---|---|---|---|---|
| RE24,313 | E * | 5/1957 | Munsey | F41G 1/32 | 42/145 |
| 2,932,896 | A | 4/1960 | Hicinbothern | | |
| 5,065,519 | A * | 11/1991 | Bindon | F41G 1/32 | 42/145 |
| 5,327,654 | A | 7/1994 | Parker | | |
| 5,519,941 | A | 5/1996 | Yusko | | |
| 35,347 | A | 10/1996 | Bindon | | |
| 5,638,604 | A * | 6/1997 | Lorocco | F41G 1/345 | 42/126 |
| 5,836,100 | A * | 11/1998 | Stover | F41G 1/345 | 42/132 |
| 6,711,846 | B1 * | 3/2004 | Nasef | F41G 1/01 | 42/130 |
| 6,769,210 | B2 | 8/2004 | Bubits | | |
| 7,451,566 | B1 | 11/2008 | Price | | |
| 7,610,712 | B2 | 11/2009 | Ertl | | |
| 7,743,546 | B2 | 6/2010 | Keng | | |
| 7,886,475 | B2 | 2/2011 | Dubois | | |
| 7,905,044 | B2 | 3/2011 | Clouser | | |
| 7,914,334 | B2 | 3/2011 | Foratier | | |
| 8,099,874 | B2 | 1/2012 | Priebe | | |
| 8,151,511 | B2 | 4/2012 | Gentilini | | |
| 8,261,481 | B1 | 9/2012 | Shebaro | | |
| 8,375,619 | B2 | 2/2013 | Hewes | | |
| 8,813,413 | B2 * | 8/2014 | Howe | F41G 1/08 | 42/132 |
| 2010/0175297 | A1 * | 7/2010 | Speroni | F41G 1/35 | 42/114 |
| 2011/0005119 | A1 * | 1/2011 | Neergaard | F41G 1/01 | 42/111 |
| 2011/0107650 | A1 * | 5/2011 | Howe | F41G 1/10 | 42/132 |
| 2011/0197491 | A1 * | 8/2011 | McCann | F41G 1/033 | 42/132 |
| 2011/0314721 | A1 * | 12/2011 | Lamb | F41G 1/345 | 42/145 |
| 2012/0144721 | A1 | 6/2012 | Glimpse | | |
| 2012/0151817 | A1 * | 6/2012 | Howe | F41G 1/345 | 42/132 |
| 2012/0198750 | A1 | 8/2012 | Mansfield | | |
| 2014/0338246 | A1 * | 11/2014 | Crum | F41G 1/02 | 42/111 |
| 2014/0338522 | A1 * | 11/2014 | Bellione | F41A 3/12 | 89/139 |

FOREIGN PATENT DOCUMENTS

| | | | |
|---|---|---|---|
| FR | 2468097 | B1 | 11/1983 |
| JP | S53162600 | U | 12/1978 |
| WO | WO0177605 | A1 | 10/2001 |
| WO | WO2007/039778 | | 4/2007 |

OTHER PUBLICATIONS

Iron Sight, Wikipedia.

John Haviland, Iron Sights.

www.riflemagazine.com May-Jun. 2013.

* cited by examiner

FIG.11A
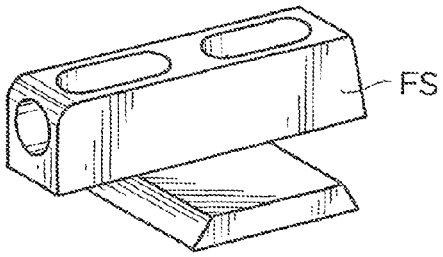
FIG.11B
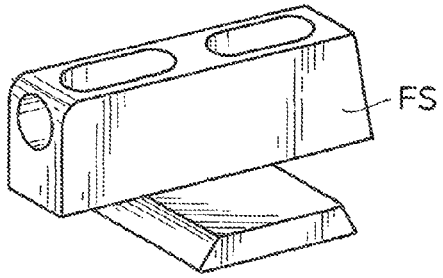
FIG.11C
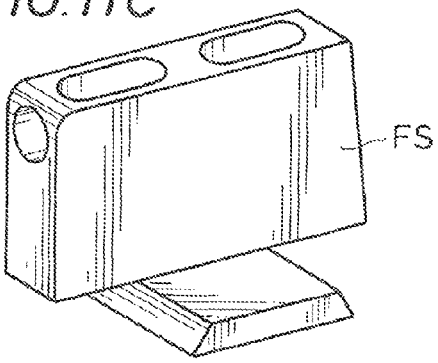
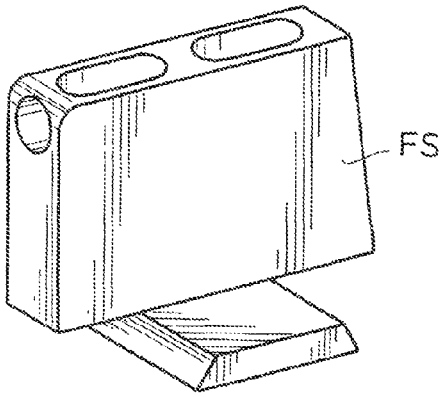
FIG.11D
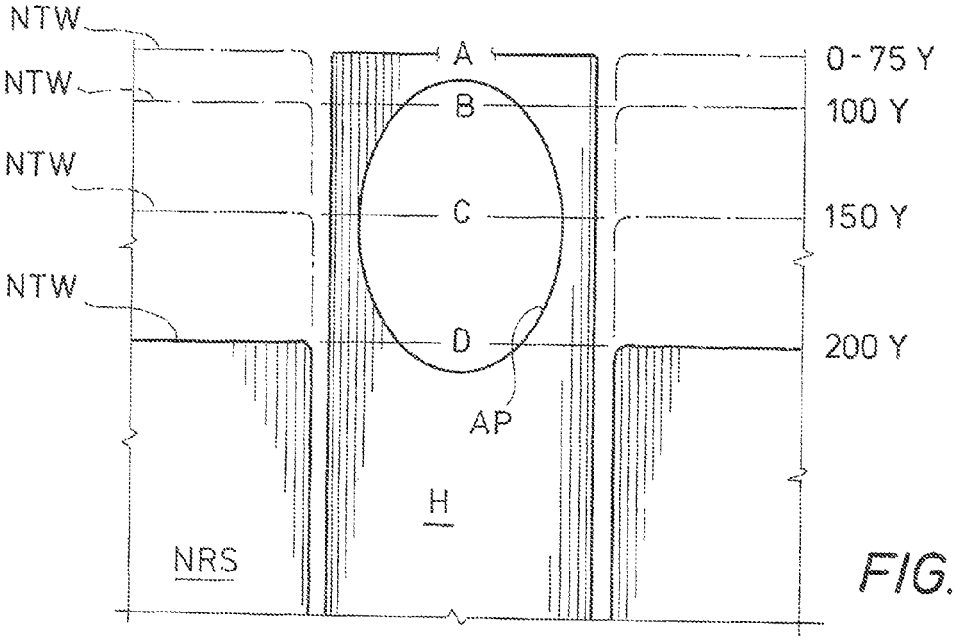
FIG.13

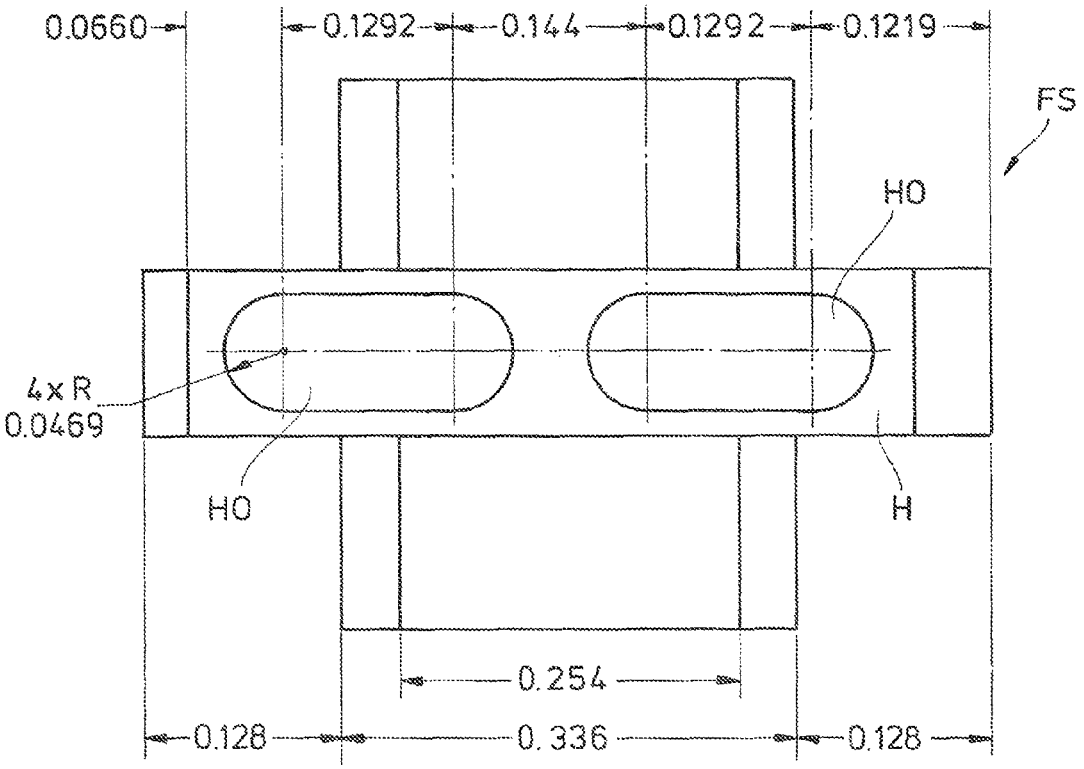
FIG.12A
FIG.12C
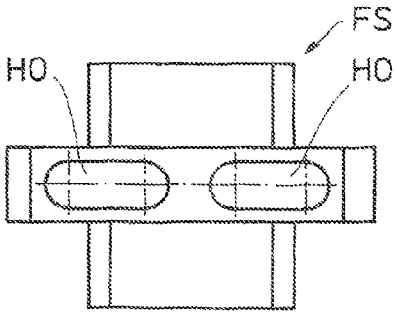
FIG.12B
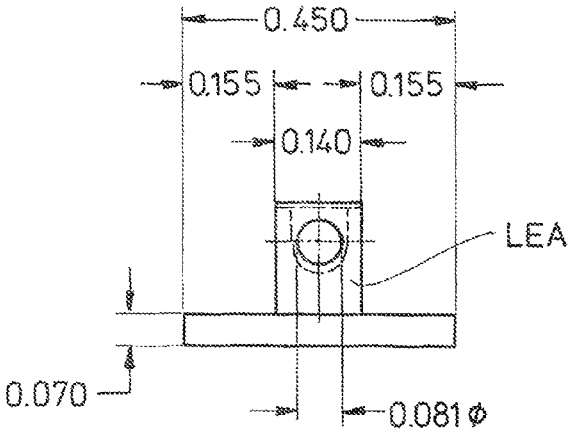

FRONT IRON SIGHT FOR A FIREARM PROVIDING A TUBULAR APERTURE THROUGH A HOUSING WITH TOP OPENING FOR LIGHT AND METHODS OF USE

CROSS REFERENCE TO RELATED APPLICATIONS

This application is related to and claims priority to two co-pending provisional applications, Application Ser. No. 61/853,836 entitled An Iron Sight for a Firearm Having an Aperture-Type Front Sight, and Method of Use, filed Apr. 12, 2013, inventors Dwight Williams and Ken Lloyd and provisional Application Ser. No. 61/854,899 filed May 3, 2013 entitled An Iron Sight for a Firearm Having an Aperture Type Front Sight, and Method of Use with inventors Dwight Williams and Ken Lloyd. The content of both provisional patent applications is herein and hereby incorporated by reference in its entirety.

FIELD OF THE INVENTION

This invention relates to iron sights for firearms, and more particularly to front iron sights.

BACKGROUND OF THE INVENTION

Terminology

"Front sight" refers to the sight nearest the muzzle end of the firearm. "Rear sight" refers to the sight nearest the shooter or butt of the firearm. Generally with the instant inventive front sight, the rear sight is anticipated to comprise a standard notch sight or a standard peep sight. "Leading" is used herein to refer to the portion of the sight nearest the shooter, as installed on the firearm in operation, and "trailing" is used to refer to the portion of the sight opposite the leading portion, or furthest from the shooter in operation.

"Sight picture" is used to refer to a view resulting from a selective alignment of a front sight with a rear sight, down a sightline. A traditional sight picture comprises the top of a traditional bar or post front sight aligned with the top of the sides of a rear notch sight, or aligned with the center of a rear peep sight. The instant invention preferably offers four sight pictures, to be selected depending upon shooter preferences, distance away from target and characteristics of the firearm and/or bullet. "Hold" is used to refer to where, with respect to a front sight, a selected target point (or point on a target) is aligned. For instance the top of the bar or post is typically "held" on the point on a target selected with conventional front sights. The center, bottom, top of aperture or top of housing may be "held" on the point on the target selected with the instant front iron sight. "Placement" is used to refer to the selection of the target point itself on the target for aiming purposes. Factors such as distance away and characteristics of the firearm and bullet may affect "placement." For example, in regard to "placement" with respect to a human silhouette, if the hit should be at the chest, "placement" might be at the head or at the belt buckle, to compensate for an anticipated fall or rise of the trajectory, respectively, given the distance away and the firearm. As discussed above, the conventional bar or post front sight typically provides only one sight picture and one hold position. As a result, when a placement of the target point on the target is high on the target, the bar or post obscures the view of most of the target along the sightline.

"Top flat" refers to a flat top of a leading end of a housing of a front sight. With traditional "factory" post or bar front iron sights, the top flat is aligned with the top of the sides of a notch iron sight and a selected target point is held on the center of the top flat. This is discussed above.

Note: practically speaking with firearms, including pistols and rifles, a front sight will be approximately 18 to 36 inches away from a shooter's eye. That variation in distance has not shown itself to be a critical factor in regard to the structure of the front iron sight of the instant invention.

The instant invention comprises a novel front iron sight for a firearm and its method of use. The novel iron sight can be utilized with traditional rear sights. For example, the rear sight might comprise a standard notch iron sight or standard peep iron sight, as is known in the art. The novel front iron sight comprises a housing defining a cylindrical or tubular (of some shape) aperture. Preferably, the front iron sight will comprise an aperture of a length at least three times its diameter, between a leading end and a trailing end of the aperture. Preferably, the front iron sight is formed from a block of hard durable material, such as metal or certain plastics or the like. Preferably, the block has an aperture formed therethrough as by milling or casting or molding or laser cutting or the like. The aperture generally runs from a leading end of the housing to a trailing end of the housing. Preferably the trailing end of the aperture is somewhat larger in diameter than the leading end of the aperture. Preferably, the housing walls defining the aperture expand radially outward slightly, from leading end of aperture to trailing end of aperture, creating a slight "cone" effect.

Preferably, at least 15% of the body of the housing containing the aperture and defining the leading and trailing ends of the aperture is also milled out or otherwise "opened" on the top, or on the top and side portions, into one or more openings, between the leading and trailing ends of the aperture, to admit light. Translucent or transparent material could be added to some or all of the open space admitting light, it should be understood.

The novel front iron sight can be viewed as preferably a partial hybrid of a squared post or bar front sight and open tube front sight. (Tubular front sights are disclosed by Parker and Peddie, discussed below.) The instant invention, however, provides the novelty of a partially open (with or without transparent or translucent material, hereinafter referred to as "open") top portion(s) of the housing defining the aperture. The opening preferably serves to illuminate the leading end of the aperture from behind, as well as preferably the housing leading end top flat and housing leading end exterior side edges. The top opening together with the opening of the leading end of the aperture enhance illumination of the housing top flat, both from behind and from within.

Preferred straight exterior side wall portions of a leading end of the housing, as provided with the above described back and interior illumination, facilitates aligning the leading end of the housing of the instant front iron sight within a rear sight straight sided notch, or within a rear sight round peephole, quickly and accurately, both vertically and horizontally. This has been confirmed by testing.

Advantages

The instant front iron sight, having both an open aperture and open housing top portions:

(1) helps illuminate and define the aperture and the leading end exterior edges of the housing, including a leading top flat over the aperture and housing leading end exterior side wall edges;

(2) obscures less of a target during sighting and shooting than a solid bar or post;

(3) provides various "sight picture" options, and (4) provides alternate "hold" positions for a selected target point with respect to the front iron sight, including on the top of a flat as well as various positions in the center of the aperture, the former being especially useful for quick shots at a short distance and the latter being especially useful for long distances. Importantly, none of these alternate "hold" positions significantly obscures the target, even when "placement" of the aim point on the target is high on the target.

Further, the leading end of the aperture helps gauge the distance away of a target by noting how fully a target of a known size fills the aperture. The leading end of the aperture thus serves as a distance finder.

Surprising results in speed and accuracy at a variety of distances have been proven by repeated testing by experts and by novices of the instant invention. Much of the lengthy and varied testing process is recorded on the applicant's website. The various embodiments had to be developed and proven through testing.

The instant invention is particularly useful for rapid target acquisitions, more peripheral vision, target clarity, assistance in range finding and accuracy. All of the above is accomplished without batteries or making handgun adjustments. The instant invention gives the handgun user almost carbine accuracy. Law enforcement officers, highway patrol, border patrol, city police, military, special ops, pilots, truck drivers, sport shooters, ranchers and home protection would all benefit from the above advantages for a side arm pistol.

The instant front iron sight can be made to accommodate different velocities for a 9 mm—45 ACP or other handgun, as well. The thickness of material between flat top and upper part of orifice would be one consideration. Another consideration would be the view area of the orifice at optimum range or maximum ranges. Note that 150 yards with the pistol sight is the size of normal man size target. So if a man appears smaller vis-à-vis the aperture, he is likely farther away. If a face fits in the orifice he is likely closer than 30 yards. The smaller the target appears, the further away it will be and so forth.

As an example re distance finder: 14 inches fits just inside a preferred embodiment of the aperture at 100 yards; 16 inches fills the aperture at 100 yards; 20 inches fills the aperture at 125 yards and 23 inches fills the aperture at 175 yards. At around 200 yards, 32 inches fits inside the aperture. The rear peep and instant front sight allows the shooter to see more of the target with a crisp view of the aperture.

Given a peep rear sight, an advantage of the instant invention is that the eye can quickly center the aperture of the instant front iron sight with the aperture of the rear sight. This also allows for quick range finding. On a rifle the rear sight will likely be a peep sight. Note: the human face is approximately 6" across. This knowledge can allow the instant front iron sight to function as a target distance indicator. Note also: the crispness or clarity of the flat top of the instant front iron sight is a result of the light both above and below the flat top or of the front sight. Clarity and brightness is one advantage of a scope on a rifle. The light above and below with the instant front iron sight gives an approach to such clarity.

Discussion of Prior Art

One limitation of a typical "factory" front iron sight comprising a post or a bar, for coordination with a notch or a peep rear iron sight, is that the combination frequently provides only one hold" position of the front sight with regard to a target point. This "hold" position typically consists of aligning the top of the flat of the post with the target point. A second limitation is that the post or bar obscures vision of portions of the target below that "hold" position. Thus, when the "hold" position, to compensate for the distance away, must be placed at the top of a target silhouette, most or all of the target is obscured by the front sight post.

Parker (U.S. Pat. No. 5,327,654) and Peddie (U.S. Pat. No. 1,012,427) disclose front iron sight structures comprising an "aperture," a housing defining a front iron sight cylinder or tube. One distinction of the instant invention from the Parker front iron sight, however, is that the Parker aperture appears too large, its diameter appearing to be twice the height of the notch. Parker's housing also lacks a top flat. Because of the absence of a flat top portion and straight side wall portions on the leading end of the housing, a shooter would have difficulty aligning the Parker rounded housing walls within a squared notch straight walls and difficulty "holding" or aligning a target point on the top of the Parker circular front housing wall. Maintaining the horizontal position of a tubular front sight with rounded end housing walls within a notch defined by straight walls is difficult. And importantly, Parker provides no opening(s) in top portions of his housing to communicate in ambient light.

Peddie, to note a basic difference in design, does not utilize a rear sight at all or disclose forming any sight picture alignment between a rear sight and a front sight. Peddie does not disclose any opening in the top of the housing of his cylinder or tube front sight for providing illumination, within the cylinder or tube, of the aperture. Like Parker, Peddie's housing does not provide a flat top portion or straight exterior side portions for hold and alignment purposes with a rear sight.

In regard to other prior art that teaches hooded crosshairs or hooded beads on a post as a front ironsight, the instant aperture is sufficiently small that crosshairs or beads on a post in the sightline within the aperture would significantly obscure any target at significant distances. The instant invention calls for an open, unobstructed aperture.

SUMMARY OF THE INVENTION

The invention includes a front firearm iron sight including a housing defining a front iron sight with an aperture through the housing. Preferably the aperture is at least 0.20 inches between a leading end of an aperture and a trailing end of the aperture. Preferably the aperture provides an open unobstructed sightline therethrough, with a leading end of the aperture having a diameter of approximately 0.10 inch +/−0.05 inches. Preferably the leading end of the housing presents, along a sightline, approximately straight exterior sidewall portions and approximately straight top flat portion.

Preferably at least 15% of the top portion of the housing between the leading end and the trailing end of the aperture is open to provide passage of ambient light to a backside of the leading end of the aperture.

BRIEF DESCRIPTION OF THE DRAWINGS

A better understanding of the present invention can be obtained when the following detailed description of the preferred embodiments are considered in conjunction with the following drawings, in which:

FIG. 1 shows a view from the shooter's eye, referred to as the rear of the pistol. FIG. 2 illustrates a perspective of the sight from the rear and slightly to the left. FIG. 3 illustrates a side view of the front sight on the pistol. FIG. 4 illustrates a front view or a view down the muzzle of the front sight. FIG. 5 illustrates at top view of the sight.

FIGS. 11A-11D are perspectives of a front sight for rifles with a dovetail and for a Glock. FIGS. 12A-12E illustrate engineering drawings for a prototype of the instant front iron sight.

FIG. 13 illustrates a plurality of sight pictures, or alignments of the front sight with a rear sight, that are possible with an embodiment of the instant inventive front iron sight.

The drawings are primarily illustrative. It would be understood that structure may have been simplified and details omitted in order to convey certain aspects of the invention. Scale may be sacrificed to clarity.

DETAILED DESCRIPTION OF PREFERRED EMBODIMENTS

The drawings illustrate the structure of preferred embodiments of the instant front iron sight FS, together with a sight system enabled thereby. FIGS. 1-5 are drawn from pictures of an embodiment of the instant invention installed on a pistol FA.

Figure 1:
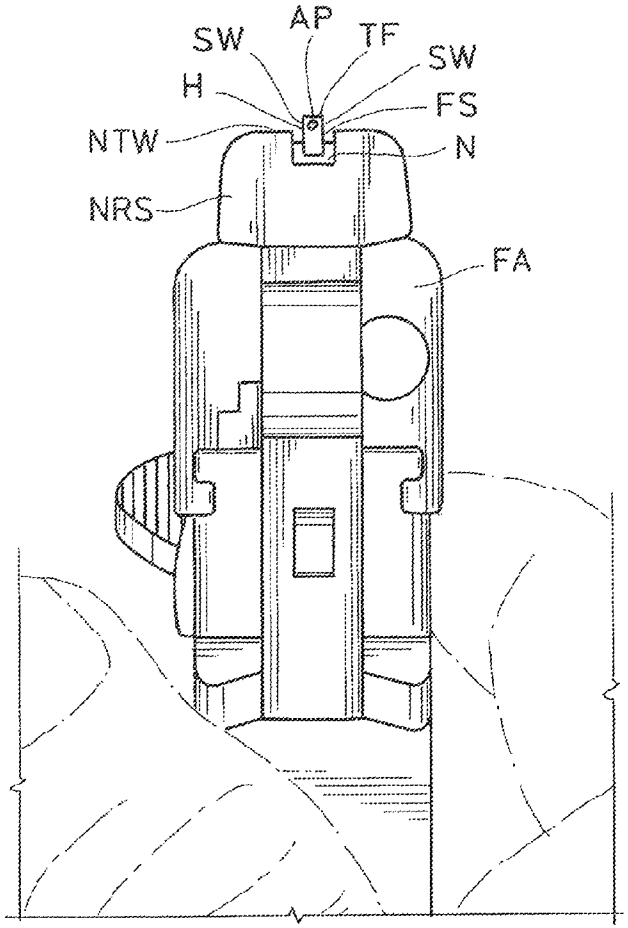
FIGS. 1-5 provide an embodiment of the instant front iron sight as installed on a pistol.
Figure 2:
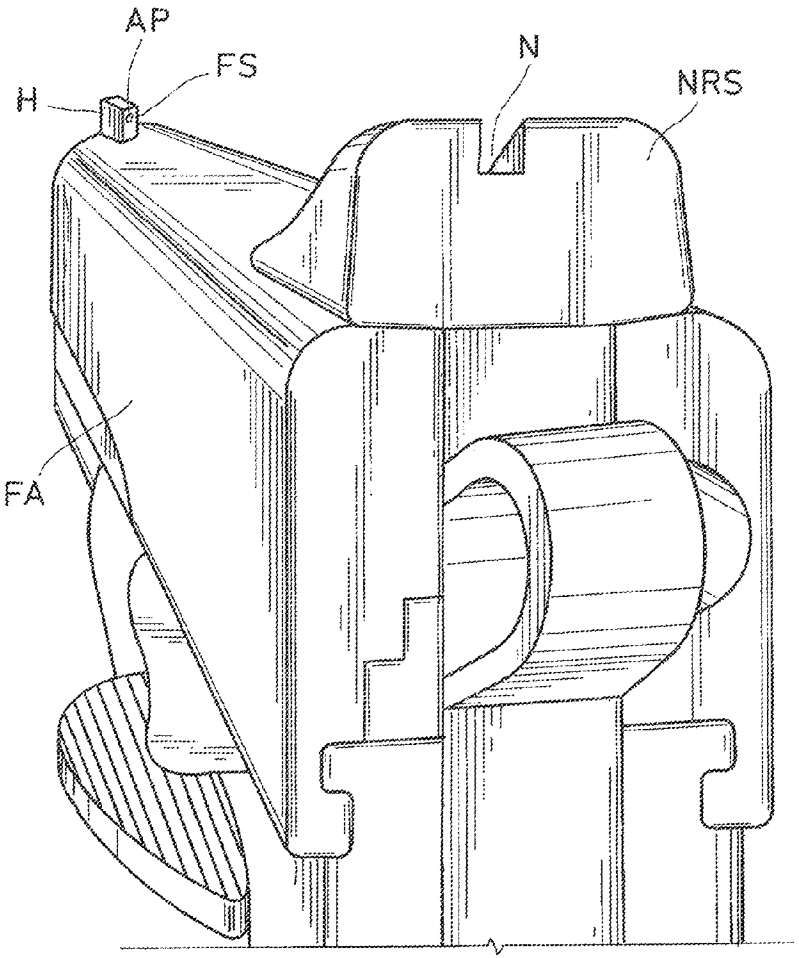
Figure 3:
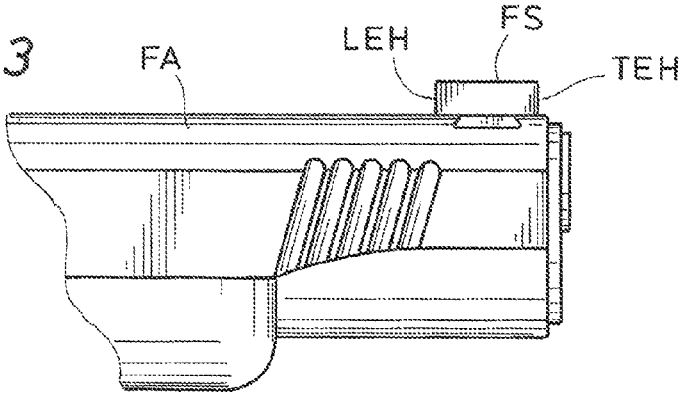
Figure 4:
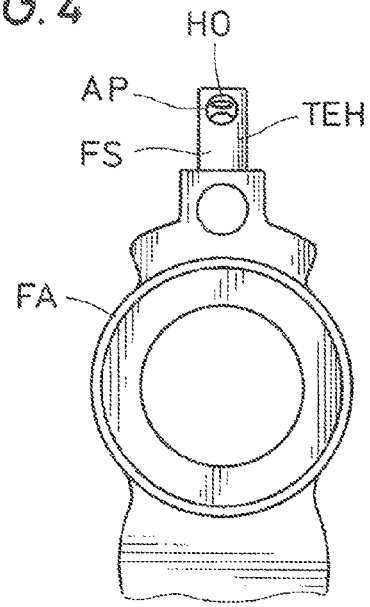
Figure 5:
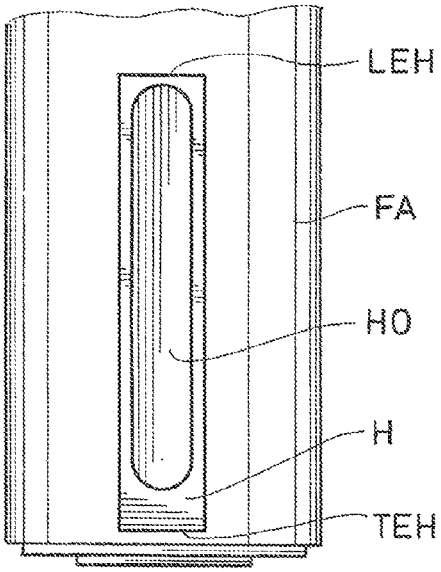

FIG. 1 captures the relative size and proportion of an exemplary embodiment of the instant front iron sight FS, the figure depicting a view taken down a sightline of a pistol FA from the shooter's perspective. FIGS. 2-5 offer views of the same front iron sight and pistol taken from the left rear, from the side, from the front and from above the gun. FIG. 2 offers a perspective of the instant front iron sight taken from the rear and slightly to the left. FIG. 3 offers a side view of the front iron sight. FIG. 4 offers a perspective taken from the front or muzzle end of the iron sight, showing some of the "opening" HO in the top of the front sight housing, the opening providing illumination to the aperture AP. FIG. 5 depicts a top view of the embodiment, showing an open top aperture.

The inventive front iron sight can be machined or milled out or cast from a metal or synthetic material such as space age plastic that has the qualities of brass, steel or aluminum. The entire sight could be manufactured with any of such material options. A block of clear or magnified material might be put in the middle area to further enhance visibility and strengthen milled walls.

Figure 6:
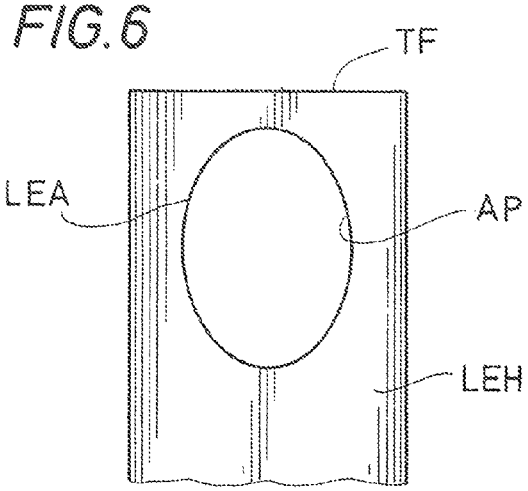
FIGS. 6 and 7 offer simplified drawings of a leading end of the front iron sight and a top view of the same embodiment.
Figure 7:
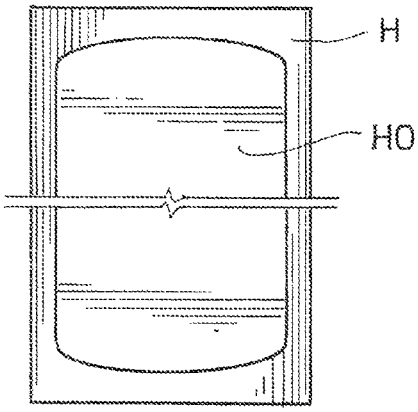
Figure 12D:
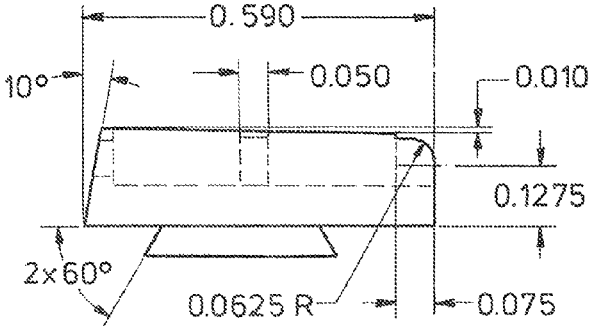
Figure 12E:
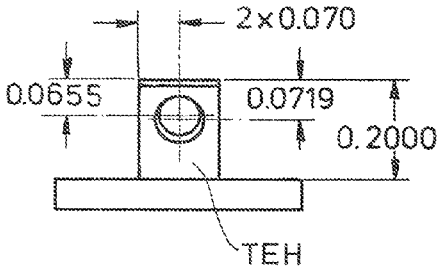

FIGS. 6-7 illustrate the scale of a preferred embodiment of the front iron sight FS. In a preferred embodiment the width of the leading end of the housing LEH of the front sight is approximately 0.130 inches or a 130 thousandths of an inch. The width of the leading edge of the aperture LEA in the leading end of the housing LEH is approximately 82 thousandths of an inch or 0.082 inches. The space between the top of the leading end of the aperture and the flat top TF and side portions SW of the leading end of the housing LEH is approximately 20 thousandths of an inch or 0.020 inches. FIG. 7 illustrates structuring of a milled out (or the like created) area HO of top portions of the housing H of the front iron sight, for admitting light. Although not illustrated in the above drawings, the trailing end of the aperture TEA is preferably slightly larger in size than the leading end of the aperture, by about 10 percent, in order to not obstruct view through the leading end of the aperture. See FIGS. 12 A-E. Technically, a trailing end of the aperture is not necessary, but it provides structural integrity, important to an iron sight.

Figure 8A:
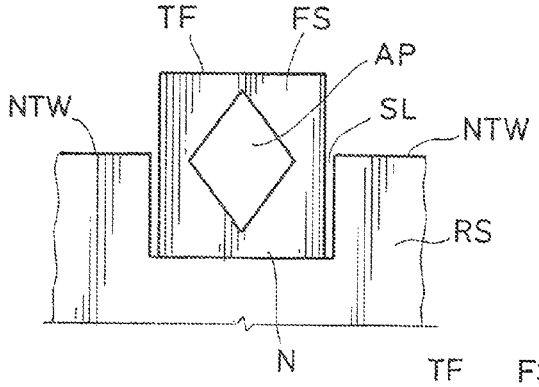
FIGS. 8A-8C illustrate an embodiment of the instant front sight viewed through a notch rear sight and indicates that the shape of the aperture, although commonly a circle, could be oval or diamond or rectangular or any other useful shape.
Figure 8B:
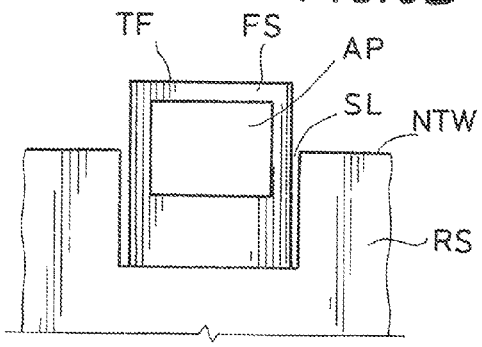
Figure 8C:
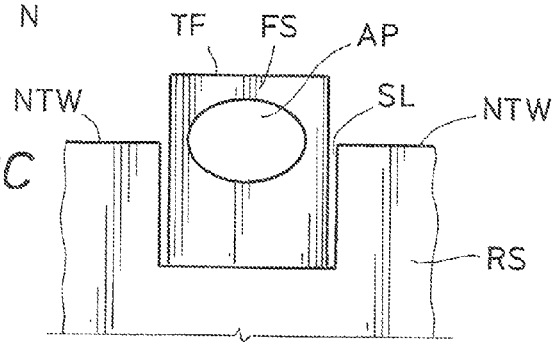

FIGS. 8A-8C illustrate that the aperture AP of the instant front iron sight need not be circular. A circular aperture is easier to mill out. The aperture, however, could be oval, FIG. 8C, or rectangular, FIG. 8B, or diamond shaped, FIG. 8A, or otherwise. FIGS. 8A-8C illustrate such different sized apertures in a front sight as aligned within a rear notch sight NRS.

Figure 9A:
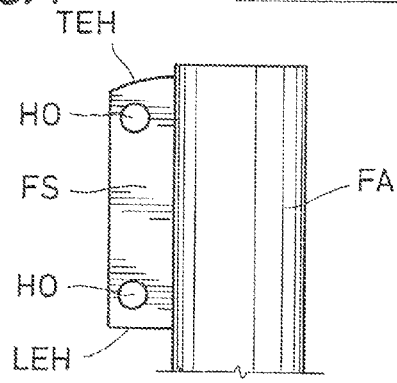
FIGS. 9A-9B illustrate a front sight from the side and from the top to illustrate that the openings in the top and/or possibly in the top of the sides of the front iron sight could be of different sizes and positions.
Figure 9B:
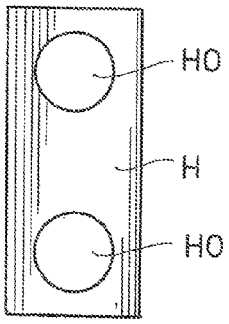

FIGS. 9A, B and 10A, B, C illustrate a side view and a top view of an embodiment of the instant front iron sight, in particular to illustrate the possible placement of openings or holes HO for admitting light into the aperture AP of the sight. FIG. 9A illustrates that side holes may be added for additional light. FIG. 9B illustrates the use of a large front and large rear hole, possibly with smaller holes in the side to include greater light.

The applicant performed testing in order to determine the least amount of light required to see well in order to engage targets at ranges within a firearm's capability. It is preferred that the instant front iron sights are useful in rugged environments. While more light is preferable, the front sight must also be of sufficiently rugged construction as to not be deformed. It was determined that holes for light in the top sides of the sights add more light but were generally not needed under normal shooting conditions. Of course, the holes formed in the sight do not have to be round.

Figure 10A:
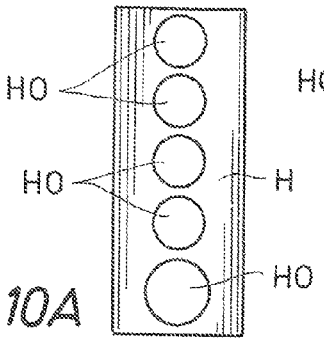
FIGS. 10A-10C illustrate different openings that can be used in the top of a front sight to communicate light to the aperture.
Figure 10B:
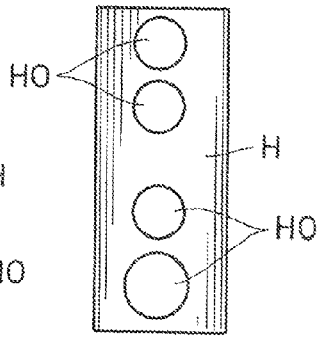

FIGS. 10A and 10B illustrate further holes HO in the top of a front iron sight. The instant inventor experimented with holes varying in size from 0.625 through 0.930. It is believed that a series of holes is stronger than one long milling cut. A larger hole was determined to be preferred near the leading end of the aperture LEA of the sight. Again, FIG. 10B illustrates that greater distance between the holes allows for less light but makes for a more rugged sight. Again, a larger hole close to the leading end of the aperture is important. The second most important hole appears to be a hole near the trailing end of the aperture.

Figure 10C:
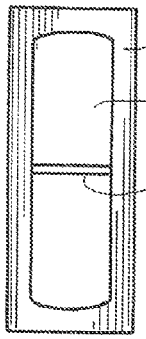

FIG. 10C illustrates a milled out hole in the top of the sight with an added bridge BR for strength.

FIGS. 11A-11D illustrate various commercial embodiments of the instant invention. FIG. 11A is a front sight for a 1911 rifle with a dovetail for installation. FIG. 11B and 11C illustrate additional front sights for rifles with dovetails. FIG. 11D illustrates a front sight for a Glock.

FIGS. 12A-12E represent engineering drawings for a front sight prototype.

FIG. 13 presents a simple illustration of a variety of four sight pictures offered by the instant invention as combined with a rear notch sight NRS. Position A which could be used for 0 to 25 yards away aligns the top of the housing H of the inventive front iron sight with the top sides of the rear notch sight NTW. Position B, possibly for use at 100 yards, aligns the top of the aperture with the top of the notch sides. Position C which could be used for 150 yards aligns the center of the aperture with the top of the notch sides. Position D which could be used for distance of 200 yards aligns the bottom of the aperture with the top of the notch of the rear sight.

Figure 14A:
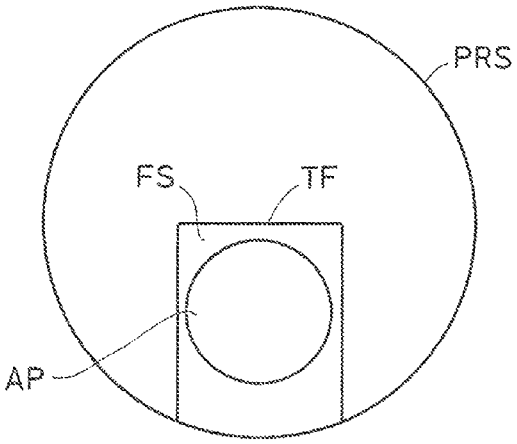
FIGS. 14A-14B illustrate a variety of sight pictures available for an embodiment of the instant front iron sight coordinated with a rear peep sight.
Figure 14B:
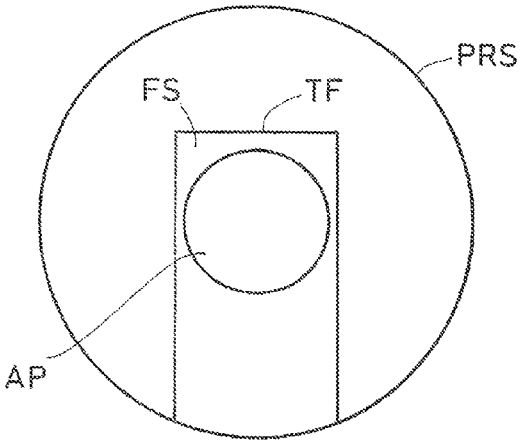

FIGS. 14A and 14B illustrate two different sight pictures using the inventive front iron sight and a rear peep sight PRS. FIG. 14A illustrates aligning the top of the housing of the front of the inventive front iron sight with the center of the peep. FIG. 14B illustrates aligning the center of the aperture of the inventive front iron sight with the center of the peep. The position of FIG. 14A might be used for short to medium range shots, depending on velocity and ballistic characteristics of the bullets. It might be used for shots of to 300 yards. The position for FIG. 14B might be used for extended or long range shots, shots of 300 or greater yards, again depending on the velocity and ballistic co-efficient. For even longer range the bottom of the aperture might be centered in the peep.

Figure 15A:
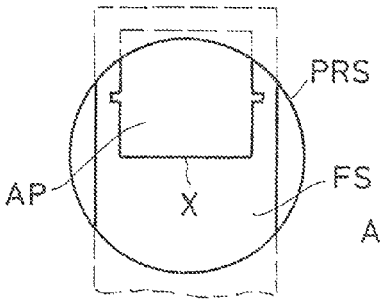
FIGS. 15A-15C illustrate various sight pictures possible with the inventive front sight and a rear peep sight.
Figure 15B:
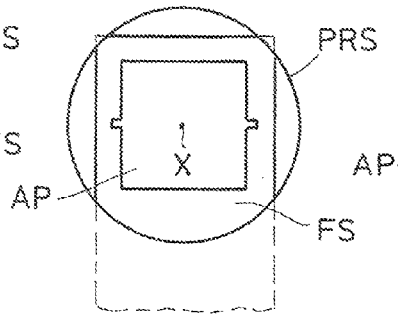
Figure 15C:
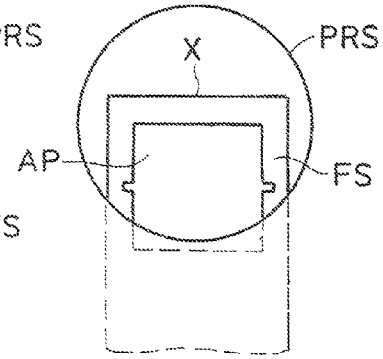

FIGS. 15A-15C illustrate again sight pictures, where X is the hold point, coordinating the instant inventive front iron sight with a peep sight PRS as typically found in a rifle. FIG. 15A aligns the bottom of the aperture with the center of the peep. FIG. 15B aligns the center of the aperture with the center of the peep and FIG. 15C aligns the top of the aperture with the center of the peep. Notice that the aperture in these embodiments is square or rectangular.

Figure 16:
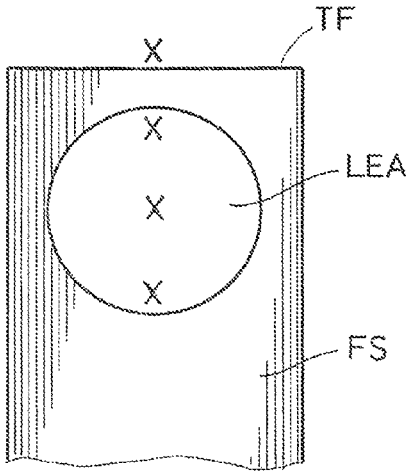
FIG. 16 illustrates four key "holds" available with an embodiment of the instant invention, holding target X on the front sight.
Figure 17:
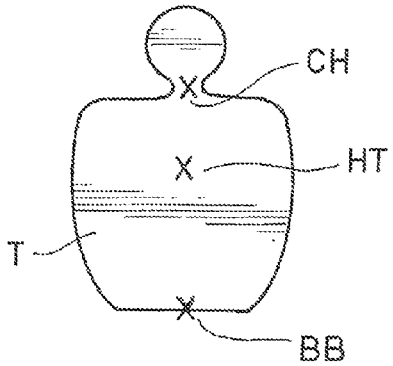
FIG. 17 illustrates three key placements of a target X on a silhouette, as is known in the art.

FIG. 16 again illustrates 4 key holds of a target X on a front sight. FIG. 17 illustrates three key placements of a target X on a silhouette, chin CH, heart HT and belt buckle BB.

Figure 18A:
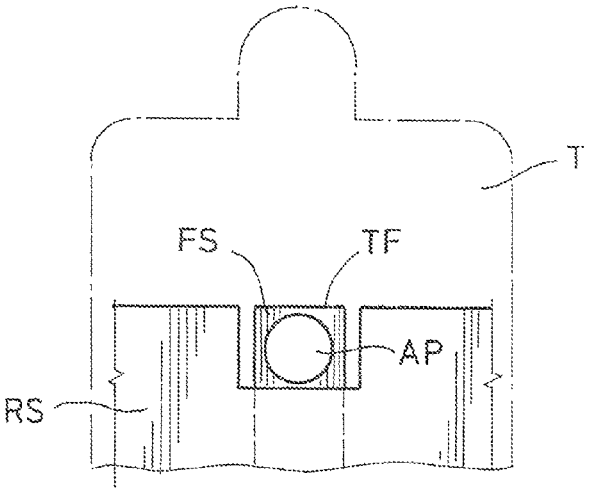
FIGS. 18A-18B illustrate a variation in how a target fills an aperture of the front sight as a function of distance away.
Figure 18B:
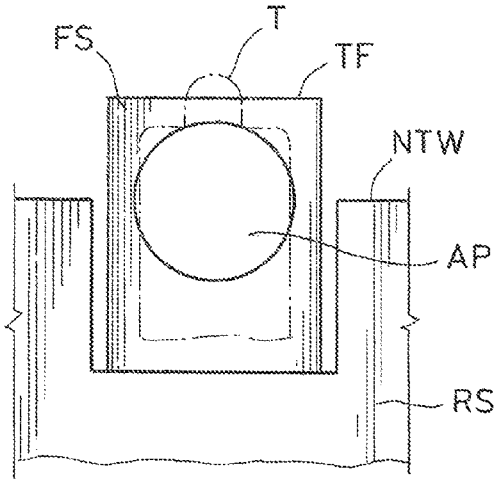

FIGS. 18A and 18B illustrate how a target T fills an aperture AP differently depending upon the distance away of the target. In FIG. 18A only a portion of the target is visible through the aperture. In FIG. 18B almost all of the target is visible through the aperture. FIG. 18B might be what one sees of a human silhouette at 100 yards. FIG. 18A might be what one sees of a human silhouette at 25 yards. It can be seen, thus, that instant front iron sights functions incidentally as a distance finder, since the relative size of a target in regard to the front sight leading aperture can be understood as an indicator of the distance away of the target.

Testing

Extensive testing has been carried out with the instant invention, informing its final structure and substantiating its superiority to the available prior art. Results of the testing can be found at the Battle Sight website, including comparative testing results between the Battle Sight system and other sight systems. The shooting results also indicate different shooters.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below. Since the foregoing disclosure and description of the invention are illustrative and explanatory thereof, various changes in the size, shape, and materials, as well as in the details of the illustrated device may be made without departing from the spirit of the invention. The invention is claimed using terminology that depends upon a historic presumption that recitation of a single element covers one or more, and recitation of two elements covers two or more, and the like. Also, the drawings and illustration herein have not necessarily been produced to scale.

The invention claimed is:

1. A front firearm iron sight, comprising:

a housing defining a front iron sight with an aperture through the housing, the aperture at least 0.20 inches long between a leading end of the aperture and a trailing end of the aperture;

the aperture structured to provide an open unobstructed cross sectional area of field of view, along a straight sightline therethrough, from leading end to trailing end, for providing an unobstructed view of a target therethrough; and at least 15% of the top portion of the housing between the leading end and the trailing end of the aperture being open to provide passage of ambient light for illumination to the aperture;

wherein the leading end of the housing presenting, along the sightline, approximately straight exterior side wall portions and an approximately straight top flat portion and the cross sectional area of field of view along the straight sightline through the aperture not decreasing from the leading end to the trailing end; and wherein the trailing end of the aperture having at least a 10% greater diameter than the leading end of the aperture.

2. The front iron sight of claim 1 with the leading end of the aperture having a diameter of approximately 0.10 inch +/−0.05 inches.

3. The iron sight of claim 1 with the open top portion of the housing structured to provide passage of ambient light to a back side of the leading end of the aperture.

4. The front iron sight of claim 1 wherein the leading end of the aperture has a diameter of approximately 0.082 inches.

5. The front firearm sight of claim 1, 2, 3 or 4 wherein the front sight includes a trailing end of the aperture located along a sightline through the leading end of the aperture, at a distance of 5 to 10 times the leading end aperture diameter.

6. The front firearm iron sight of claim 1, with the leading end of the aperture structured with a diameter for providing an approximate 5 inch+/−2 inch view of a target therethrough at a distance of 20 yards and an approximate 45 inch+/−15 inch view of the target therethrough at a distance of approximately 200 yards, for a shooter's eye located 26 +/−10 inches away from the leading end of the aperture.

7. The front firearm iron sight of claim 1 including the aperture structured for providing a view of a target therethrough such that a target aim point can be visibly aligned within the sightline through the passage and with the aperture, excepting the open portion, defined by substantially continuous smooth-bore interior walls of substantially circular cross section, providing a substantially circular field of view therethrough.

8. A firearm iron sight system comprising:

the front firearm iron sight of claim 1 and including:

a rear sight providing a notch with approximately straight notch side wall portions and approximately straight notch top wall portions on both sides of the notch;

and wherein the rear sight and front sight are located and structured in combination with a firearm such that exterior side wall portions of the housing leading end operationally align substantially parallel with notch side walls portions along a sightline and such that a leading end straight top flat portion of the housing operationally aligns substantially parallel with rear sight straight top wall portions, and such that the leading end of the aperture operationally fits within a field of view through the notch such that slits of light are visible between said housing side wall portions and said notch side wall portions along the sightline.

9. A firearm iron sight system comprising:

the front firearm iron sight of claim 1 and including:

a rear peep sight providing a peephole for aligning with the front sight;

and wherein the rear sight and front sight are located and structured in combination with a firearm such that a (1) center of the leading end of the aperture or (2) the housing leading end straight top flat portion operationally aligns substantially centrally with the peephole.

10. The firearm iron sight system of claim 8 or 9 including the aperture structured for providing a view of a target therethrough such that a target aim point can be visibly aligned within the sightline through the passage.

11. A method of aiming a firearm having at least a front iron sight in accordance with claim 1, 2 or 7 comprising sighting a selected aim point on a target through the aperture in the housing of the front iron sight.

* * * * *